US009352879B2

(12) United States Patent
Makofsky et al.

(10) Patent No.: US 9,352,879 B2
(45) Date of Patent: May 31, 2016

(54) BLANK FOR MAKING A MAILER AND MAILER MADE THEREBY

(71) Applicants: Marvin A. Makofsky, Manhasset, NY (US); Robert Makofsky, New York, NY (US); Sari Makofsky McConnell, Burlingame, CA (US)

(72) Inventors: Marvin A. Makofsky, Manhasset, NY (US); Robert Makofsky, New York, NY (US); Sari Makofsky McConnell, Burlingame, CA (US)

(73) Assignee: CONFORMER PRODUCTS, INC., Port Washington, NY (US)

( * ) Notice: Subject to any disclaimer, the term of this patent is extended or adjusted under 35 U.S.C. 154(b) by 0 days.

(21) Appl. No.: 14/632,625

(22) Filed: Feb. 26, 2015

(65) Prior Publication Data

US 2015/0175311 A1 Jun. 25, 2015

Related U.S. Application Data

(62) Division of application No. 13/536,118, filed on Jun. 28, 2012, now Pat. No. 9,004,345.

(51) Int. Cl.
*B65D 27/14* (2006.01)
*B65D 27/00* (2006.01)
*B65D 27/34* (2006.01)

(52) U.S. Cl.
CPC ..... *B65D 27/14* (2013.01); *B65D 27/00* (2013.01); *B65D 27/34* (2013.01)

(58) Field of Classification Search
CPC ..... B65D 27/22; B65D 31/10; B65D 27/00; B65D 5/0005; Y10S 229/928
USPC ..... 229/75, 79, 313, 300, 301, 307
See application file for complete search history.

(56) References Cited

U.S. PATENT DOCUMENTS 1,340,553 A * 5/1920 Nissen ..... B65D 31/00 229/117.05
1,424,024 A * 7/1922 Larsen ..... B65D 27/36 229/307
1,552,642 A * 9/1925 Parks ..... B65D 27/22 229/75
2,219,526 A * 10/1940 McLaren ..... B65D 27/02 229/75
2,281,452 A * 4/1942 Ottinger ..... B65D 27/26 229/68.1
2,945,616 A * 7/1960 Normandin ..... B65D 5/0005 229/67.3
2,945,617 A * 7/1960 Normandin ..... B65D 5/0005 229/67.3
3,063,618 A * 11/1962 Berkowitz ..... B65D 5/0005 229/67.3
3,073,508 A * 1/1963 Hiersteiner ..... B65D 31/10 229/67.3
3,125,279 A * 3/1964 Watts et al. ..... B65D 27/22 229/117.06

(Continued)

*Primary Examiner* — Peter Helvey
(74) *Attorney, Agent, or Firm* — Francis C. Hand; Carella, Byrne et al.

(57) ABSTRACT

The mailer is made from a single blank. In one embodiment, the side flaps are folded over a front panel followed by folding over and securing of a back panel to the said flaps to form the mailer. The closure panel is folded over the front panel to close the mailer. In another embodiment, a back panel is folded over a front panel followed by folding over and securing of the side flaps to the back panel to form the mailer. The closure flap is folded over the back panel to close the mailer. In another embodiment, a blank forms a center seam mailer. Each embodiment has an improved corner construction.

23 Claims, 7 Drawing Sheets

(56) References Cited

U.S. PATENT DOCUMENTS 3,167,242 A * 1/1965 Meyer ..... B65D 5/0005 229/67.3
3,643,858 A * 2/1972 Deckys ..... B65D 27/08 229/72
4,462,538 A * 7/1984 Gendron ..... B65D 27/00 206/806
4,549,688 A * 10/1985 Ozmon ..... B65D 5/3685 229/117.06
4,667,819 A * 5/1987 Lu ..... G11B 33/0494 206/308.3
D295,536 S * 5/1988 Forbes, Jr. ..... 229/68.1
4,744,509 A * 5/1988 Buchler-Dopheide . B42D 15/08 229/68.1
4,809,904 A * 3/1989 Yasutaniya ..... B65D 5/18 206/521
4,896,821 A * 1/1990 Bell ..... B65D 27/10 229/68.1
5,024,373 A * 6/1991 Riel ..... B65D 27/00 229/68.1
5,398,866 A * 3/1995 Bluemle ..... B31B 3/00 229/117.01
5,799,862 A * 9/1998 Gray ..... B65D 5/3685 229/67.3
6,109,511 A * 8/2000 Schluger ..... B65D 27/00 229/103.2
6,820,799 B2 * 11/2004 Makofsky ..... B65D 5/0005 229/68.1
6,866,183 B2 * 3/2005 Purcell ..... B65D 27/00 229/68.1
7,356,953 B2 * 4/2008 Davis ..... G09F 1/06 206/0.81
7,726,547 B2 * 6/2010 Tachikawa ..... B65D 27/22 229/67.3
2003/0034383 A1 * 2/2003 Purcell ..... B65D 27/00 229/68.1
2005/0098615 A1 * 5/2005 Lockhart ..... B42F 7/02 229/67.3
2008/0290144 A1 * 11/2008 Makofsky ..... B65D 81/03 229/68.1
2008/0290145 A1 * 11/2008 Makofsky ..... B65D 7/26 229/68.1

* cited by examiner

BLANK FOR MAKING A MAILER AND MAILER MADE THEREBY

This application is a Division of U.S. Ser. No. 13/536,118, filed Jun. 28, 2012.

This application relates to a blank for making a mailer and to a mailer made thereby.

As is known, various types of mailers have been used for the mailing and shipment of documents and things. For example, U.S. Pat. Nos. 6,820,799 and 6,564,994 each describe an expandable envelope construction made from a single blank.

It is an object of this invention to provide a one piece blank that can be readily folded into a mailer having an improved construction over previously known mailers.

It is another object of the invention to provide a mailer of improved construction over previously known mailers.

It is another object of the invention to provide a mailer of improved construction that can be manufactured on readily available equipment as efficiently as possible It is another object of the invention to provide a mailer that can be used on commonly available high speed envelope insertion equipment It is another object of the invention to provide an expandable mailer with improved strength and durability of mailer in the closure area It is another object of the invention to provide an expandable mailer with improved openness of the interiors of the corners to minimize jamming or restriction.

It is another object of the invention to provide an expandable mailer that can be hand assembled using peel and stick tape on side tabs.

It is another object of the invention to provide an expandable mailer that has improved construction without score lines on the front panel.

It is another object of the invention to provide an expandable mailer that has greater capacity than similar sized mailers It is another object of the invention to provide an expandable mailer that can be modified to be a reusable portfolio with reusable closure.

Briefly, the invention provides a one piece blank made of cardboard or any other suitable material for a mailer.

In one embodiment, the blank includes a front panel, a pair of side flaps that extend from the front panel, a back panel and a closure panel wherein the side flaps are to be folded over the front panel, the back panel then secured to and over the side flaps and the closure panel closed over the front panel to form a mailer.

The front panel and side flaps are formed with tabs with rounded edges that are to overlie each other when folded into a mailer. The rounded edges on the tabs minimize the chance that the corners will catch on other objects and tear when the tabs are glued on the outside of the back panel. When glued on the inside of the back panel, the rounded tabs reduce the potential for inserted contents to get caught on the corner of the tabs and jam.

In another embodiment, the blank includes a front panel, a pair of side flaps that extend from the front panel, a back panel and a closure panel wherein the side flaps are to be folded over the front panel, the back panel then secured to and over the side flaps and the closure panel closed over the back panel to form a mailer.

In this embodiment, each side flap of the blank is formed with a foldable tab to reinforce the upper corners of the mailer and the back panel is formed with a rhombic shaped tab on each side to reinforce the lower corners of the mailer.

In still another embodiment, the blank includes a front panel, a pair of side flaps that extend from the front panel, a bottom panel and a closure panel wherein the side flaps are to be folded over the front panel and each other to form a center seam of a mailer made from the blank, the bottom panel then secured to and over the side flaps and the closure panel closed over the side flaps to form a mailer.

These and other objects and advantages of the invention will become more apparent from the following detailed description taken in conjunction with the accompanying drawings wherein.

Figure 1:
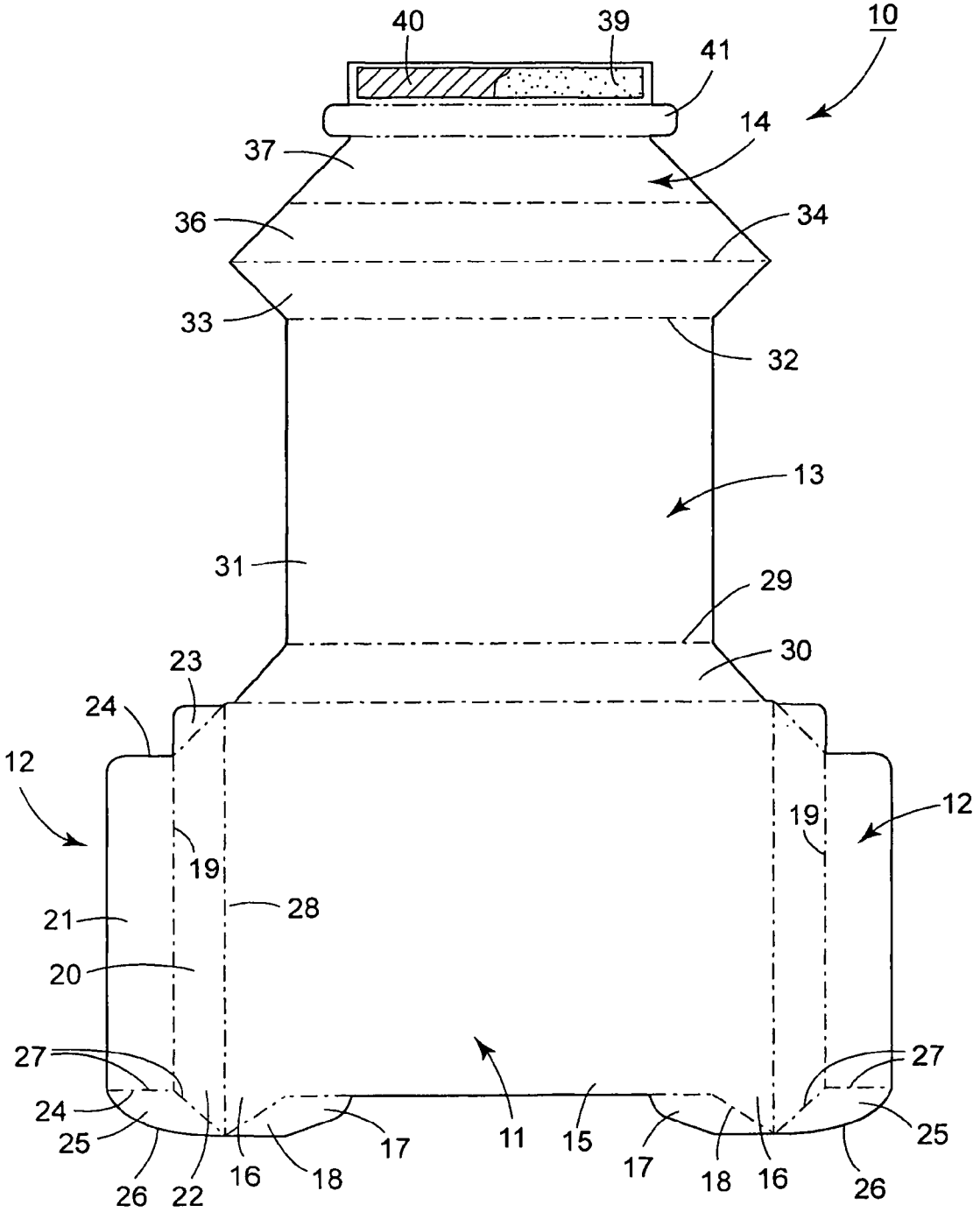
FIG. 1 illustrates a view of a blank used to make a mailer in accordance with the invention.

Referring to FIG. 1, the blank 10 is a one-piece construction made of cardboard or any other suitable material for a mailer. The blank 10 includes a front panel 11, a pair of side flaps 12 that extend from the front panel 11, a back panel 13 and a closure panel 14.

The front panel 11 has a rectangular section 15, a pair of triangular sections 16 and a pair of tabs 17. Each triangular section 16 extends from a respective corner of the rectangular section 15 and each tab 17 extends from a respective one of the pair of triangular sections 16 and the rectangular section 15. In addition, a pair of fold lines 18 are provided wherein each fold line 18 is disposed between a triangular section 16 and a tab 17 and the tab 17 has a rounded outer edge.

The rectangular section 15 of the front panel 11 may have score lines, i.e. a horizontal score line spaced from the back panel 13, a pair of vertical score lines extending from the horizontal score line and along the side edges and angular score lines extending from the intersections of the horizontal and vertical score lines to the corners of the rectangular section 15.

Each side flap 12 extends laterally from the rectangular section 15 of the front panel 11 and has a vertical score line 19 dividing the side flap 12 into a first section 20 extending from the front panel 11 and a second section 21. Each first section 20 has a triangular section 22 at one end extending from a triangular section 16 of the front panel 11 and a tab 23 extending from an opposite end. Each second (outer) section 21 is of generally rectangular shape with a horizontal edge 24 at each end.

In addition, each side flap 12 has an integral tab 25 at the lower end, as viewed, that extends from the triangular section 22 of the first section 20 and the edge 24 of the second section 21 and that has a rounded outer edge 26. The tab 25 is separated by score lines 27 from the two sections 20, 21. with the vertical score line 19 extending therethrough.

In addition, a vertical fold line 28 is provided between each side flap 12 and the front panel 11.

The back panel 13 extends from the front panel 11 for folding over the front panel 11 to define a pocket. The back panel 13 has a first horizontally disposed score line 29 dividing the back panel 13 into a first trapezoidal section 30 extending from the front panel 11 and a rectangular section 31 and a second horizontally disposed score line 32 separating the rectangular section 31 of the back panel 13 from a second trapezoidal section 33.

Alternatively, the back panel 13, as the front panel 11, may be made without the score lines 29, 32 where the blank 10 is made of light weight materials. Thus, the score lines are used for heavier weight materials to enhance the foldability function of the blank and, in the case of light weight materials, the score lines enhance the aesthetics of the mailer formed from the blank.

The closure panel 14 extends from the back panel 13 being separated by a fold line 34 and has a horizontally disposed score line 35 dividing the closure panel 14 into a trapezoidal section 36 extending from the back panel 13 and a second section 37.

Figure 4:
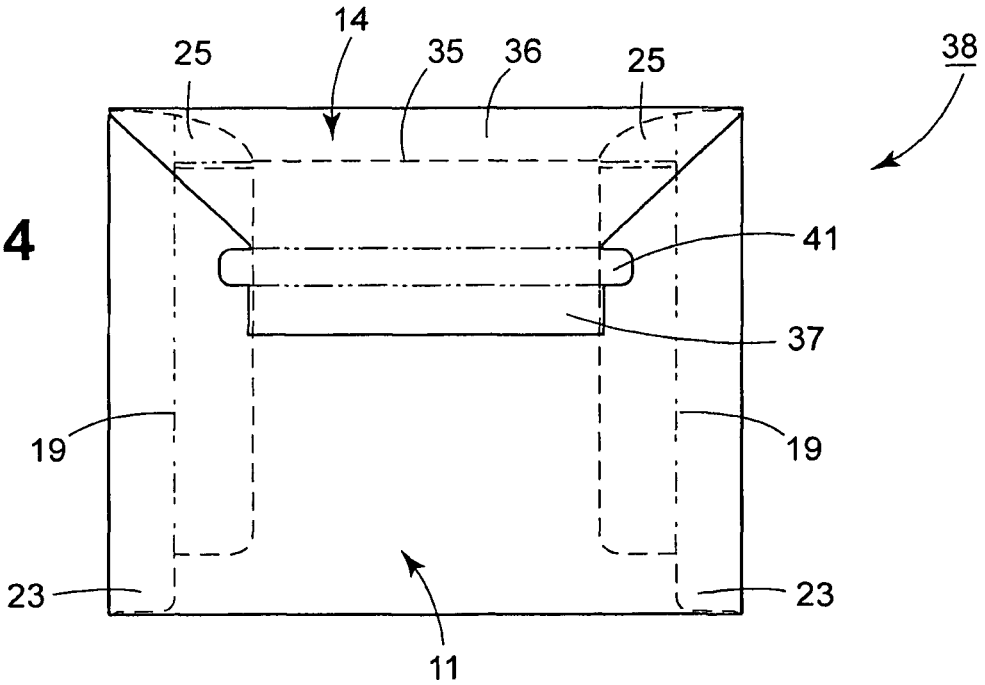
FIG. 4 illustrates the blank of FIG. 1 with the closure panel closed over the front panel to form a mailer.

Referring to FIG. 4, when folded, the blank 10 forms a mailer 38.

The closure panel 14 has an adhesive 39 on the second section 37 for adhering to the front panel 11 to close the pocket in the mailer 38 formed from the blank 10 after filling with material. This adhesive 39 may be of any suitable type, such as, permanent, cohesive, pressure sensitive and the like, and form, such as, a block, dots, lines, and the like. As illustrated, a suitable releasable cover sheet or strip 40 is applied over the adhesive 39 for transport purposes.

In addition, the closure panel 14 includes a horizontally disposed integral tear-off strip 41 between the adhesive 39 and the trapezoidal section 36 of the closure panel 14. Upon removal of the tear-off strip 41 from the remainder of the closure panel 14, access may be had to the pocket of the mailer 38.

Figure 2:
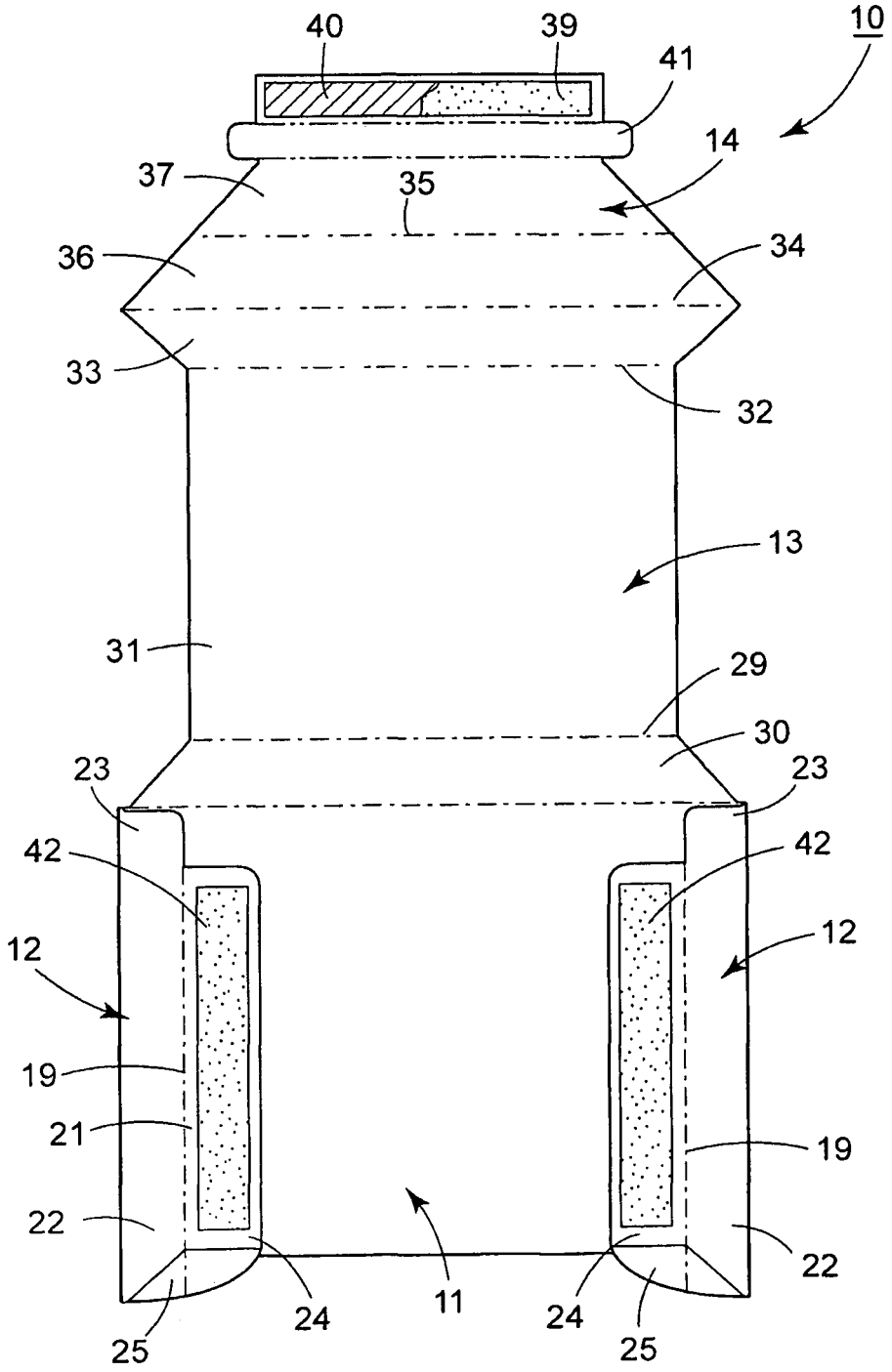
FIG. 2 illustrates the blank of FIG. 1 with the side flaps folded over the front panel.

Referring to FIG. 2, in order to form the mailer 38 of FIG. 4, the side flaps 12 extending from the front panel 11 are provided with a suitable adhesive 42 in order to be secured to the back panel 13. To this end, the adhesive 42 is applied to the underside, as viewed, of the second section 21 (i.e. the outer section) of each side flap 12 and provided with a releasable cover sheet or tape (not shown). As such, the product of FIG. 2 may be sold as shown with peel and seal tape on the side flaps 12 and closure panel 14.

Alternatively, the product of FIG. 2 could be manufactured with the side flaps 12 glued shut which is more common for mailers.

When folding the blank 10 into the mailer 38, each side flap 12 is folded over the front panel 11 with the adhesive 42 facing upwardly as shown in FIG. 2. If not previously removed, the cover strips covering the adhesive 42 are then removed from the folded over side flaps 12. At this time, the triangular section 22 of each side flap 12 overlies a triangular section 16 of the front panel 11 and the rounded tab 25 of each side flap 12 overlies a tab 17 of the front panel 11.

Figure 3:
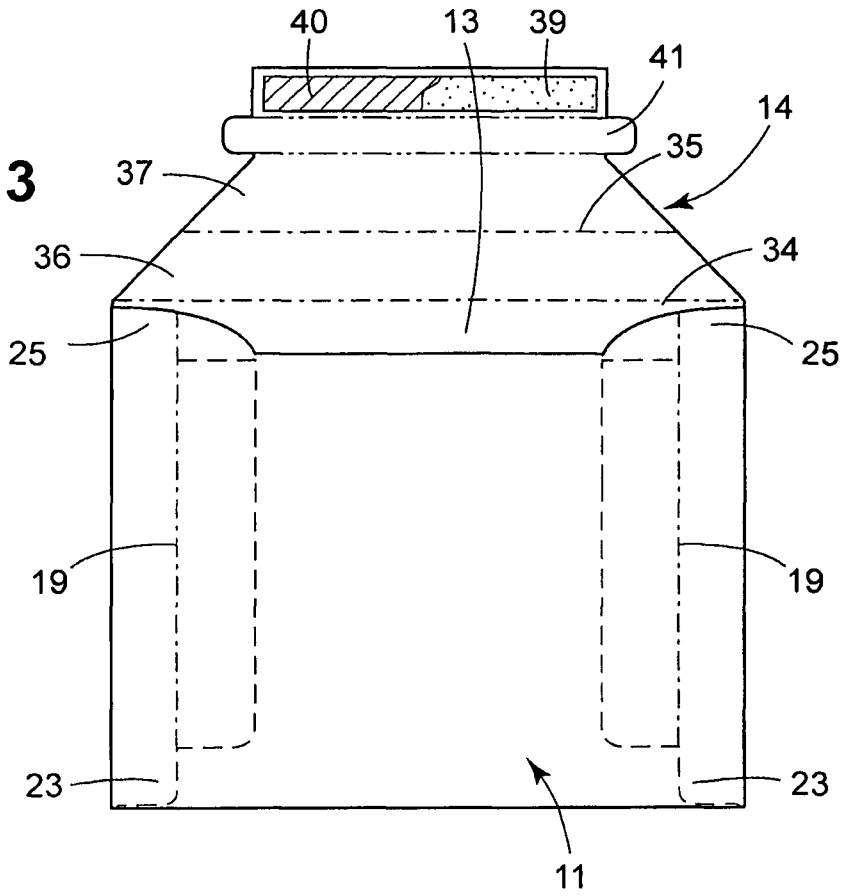
FIG. 3 illustrates the blank of FIG. 1 with the front panel and flaps folded over the back panel.

Next, as shown in FIG. 3, the back panel 13 is folded about the fold line 34 to overlie the front panel 11 and the folded over side flaps 12 (or vice versa) and the exposed adhesive 42 on the side flaps 12 secures the back panel 13 to the side flaps 12 thus forming a pocket between the front panel 11 and back panel 13.

At this time, the top edge of the front panel 11 is spaced inwardly of the top edge of the back panel 13. In particular, the second trapezoidal section 33 of the back panel 13 is exposed beyond the top edge of the front panel 11. In addition, the ends of the first trapezoidal section 30 of the back panel 13 overlie the tabs 23 of the side flaps 12 and the rectangular section 31 of the back panel 13 overlies the outer sections 21 of the side flaps 12 extending between and to the vertical score lines 19 of the side flaps 12.

The closure panel 14 may then be folded over the front panel 11 without being secured in place for shipment in bulk quantities.

When placed in use, the closure panel 14 is lifted away from the front panel 11 and the pocket of the mailer 38, as indicated in FIG. 3, so that materials may be placed in the pocket. Upon filling the pocket to capacity, the mailer expands. In this respect, the first section 20 of each side flap 12 pivots about and away from the front panel 11; the second section 21 of each side flap 12 pivots relative to the first section 20 of the side flap 12 while remaining flat and parallel to the front panel 11; the first trapezoidal section 30 of the back panel 13 pivots about and away from the front panel 11 and the rectangular section 31 of the back panel 13 remains flat and parallel to the front panel 11.

In addition, the tabs 23 of the side flaps 12 flex relative to the inner sections 21 of the side flaps 12 to maintain the lower corners of the filled mailer 38 in a closed condition.

Thereafter, the releasable cover sheet or strip 40 is removed from over the adhesive 39 and the closure panel 14 folded over the front panel 11, as indicated in FIG. 4, allowing the adhesive 39 to secure the closure panel 14 to the front panel 11 in a secure manner. At this time, the trapezoidal section 36 of the closure panel 14 overlies the second trapezoidal section 33 of the back panel 11 as well as the rounded tabs 17 of the front panel 11. In addition, depending upon the filling of the mailer 38, the second or outer section 37 of the closure flap 14 flexes more or less about the score line 35 to accommodate the thickness of the materials in the pocket of the mailer 38.

Opening of the closed mailer 38 may be accomplished by removing the tear-off strip 41 in a conventional manner.

Figure 5:
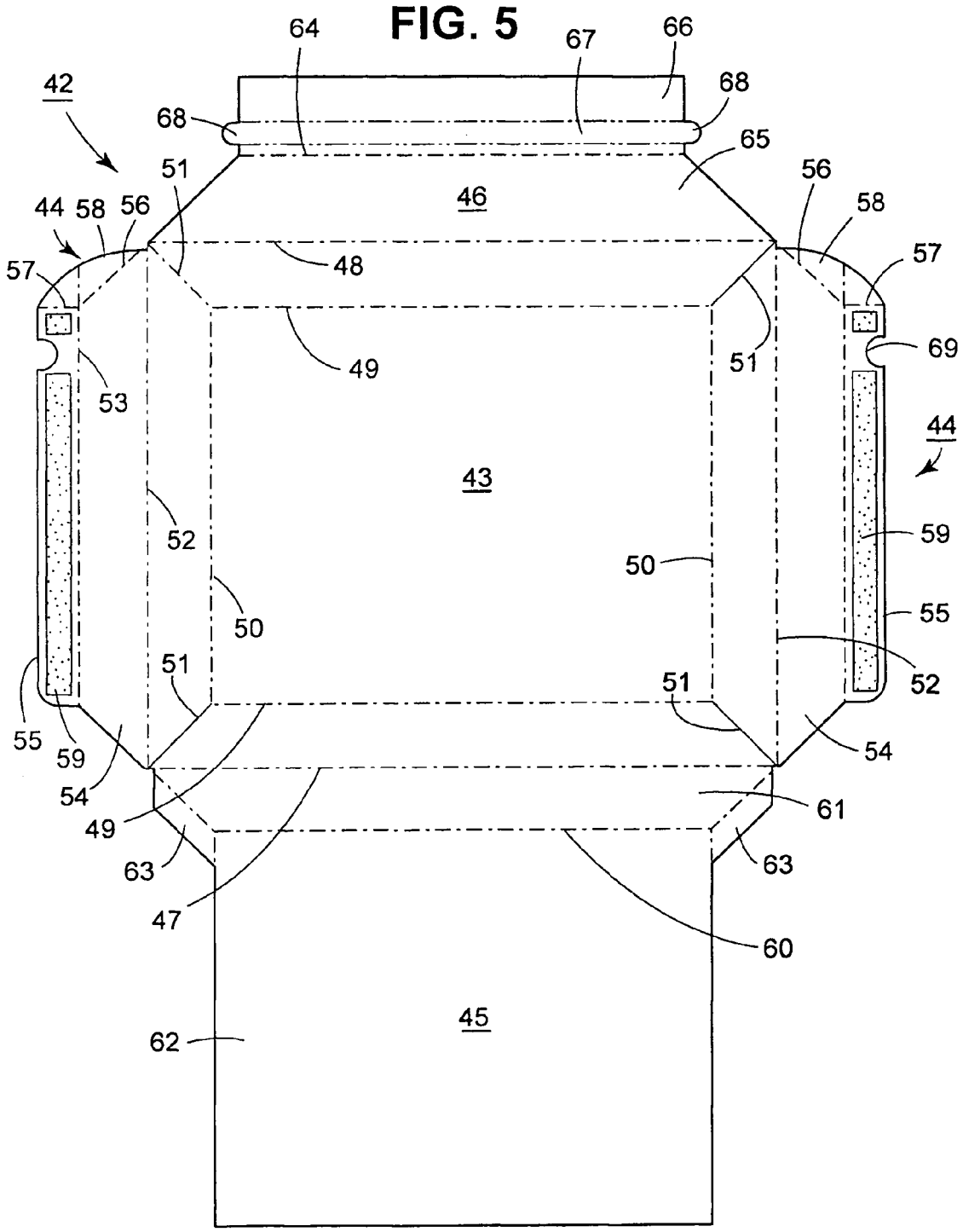
FIG. 5 illustrates a view of a blank of another embodiment used to make a mailer in accordance with the invention.

Referring to FIG. 5, in another embodiment, the blank 42 has a front panel 43 of rectangular shape; a pair of side flaps 44 extending from the front panel 43, a back panel 45 extending from a bottom edge, as viewed, of the front panel 43 and a closure panel 46 extending from a top edge, as viewed, of the front panel 43 on an opposite side from the back panel 45.

The front panel 43 is separated from the back panel 45 by a fold line 47 and from the closure panel 46 by a fold line 48. In addition, the front panel 43 may be formed with score lines, i.e. a pair of horizontal score lines 49 spaced from the back panel 45 and closure panel 46, a pair of vertical score lines 50 extending from the horizontal score lines 49 and angular score lines 51 extending from the intersections of the horizontal and vertical score lines 49, 50 to the corners of the front panel 43.

As viewed, the back panel 45 is coextensive with the front panel 43 and the closure panel 46 is coextensive with the front panel 43, i.e. the back panel 45 is of the same width as the front panel 43 at the fold line 47 and the closure panel 46 is of the same width as the front panel 43 at the fold line 48.

Each side flap 44 is separated from the back panel 45 by a fold line 52 and has a vertical score line 53 dividing the side flap 44 into a first section 54 extending from the front panel 43 and a second section 55. The first section 54 of each side flap 44 has an angular score line 56 at one end extending from the front panel 43 and the second section 55 has a horizontal score line 57 extending from the angular score line 56 to an edge of the flap 44. The angular score line 56 and horizontal score line 57 of each side flap delimits a tab 58.

The first section 54 of each side flap 44 has an angled lower edge that is to overlie an angular score line 51 of the front panel 43 when the side flap 44 is folded over the front panel 43. The second section 55 of each side flap 44 has a horizontal edge colinear with a horizontal score line 49 of the front panel 43 when the side flap 44 is folded over the front panel 43.

An adhesive 59 is applied to the second section 55 (i.e. the outer section) of each side flap 44 and is provided with a releasable cover sheet or strip (not shown). As indicated, the adhesive may be applied as one or more blocks or in any other suitable manner.

The back panel 45 extends from the front panel 43 for folding over the front panel 43 to define a pocket. The back panel 45 has a horizontally disposed score line 60 dividing the back panel 45 into a trapezoidal section 61 extending from the front panel 43 and a rectangular section 62. In addition, a pair of tabs 63 extends from the back panel 45. Each tab 63 extends from a respective end of the trapezoidal section 61 and the rectangular section 62 of the back panel 45 and is of rhombic shape. When the back panel 45 is folded over the front panel 43, each tab 63 lies over and within the contour of the first section 54 of a side flap 44.

The closure panel 46 extends from the fold line 48 and has a horizontally disposed score line 64 dividing the closure panel 46 into a trapezoidal section 65 extending from the front panel 43 and a second section 66.

As above, the closure panel 46 includes a horizontally disposed integral tear-off strip 67 in the second section 66. Upon removal of the tear-off strip 67 from the remainder of the closure panel 46, access may be had to the pocket of the mailer 38.

In this embodiment, the tear-off strip 67 has a pair of projections 68 at each end and the outer section 55 of each side flap 44 is provided with a semi-circular recess 69 to receive a projection.

As shown in FIG. 5, the upper end of each side panel 44 is spaced downwardly, as viewed, from the top edge of the front panel 43 as represented by the fold line 48 in order to accommodate for the thickness of the substrate used. Thick substrates require this downwardly space so that, when folded over, material does not pinch or bunch at the intersection of the tab 58 of a side flap 44 and the trapezoidal section 65 of the closure panel 46 along fold line 48.

Also, the trapezoidal section 61 of the back panel 45 is of slightly smaller width than the front panel 43 to provide an inward spacing to accommodate for the thickness of the substrate used. Thick substrates require this inward space so that, when folded over, material does not pinch or bunch at the intersection of the inner section 54 of a side flap 44 and the trapezoidal section 61 of the back panel 45 along fold line 47.

Also, the rectangular section 62 of the back panel 45 is of the same width as the distance between the vertical score lines 50 in the front panel 43.

Figure 6:
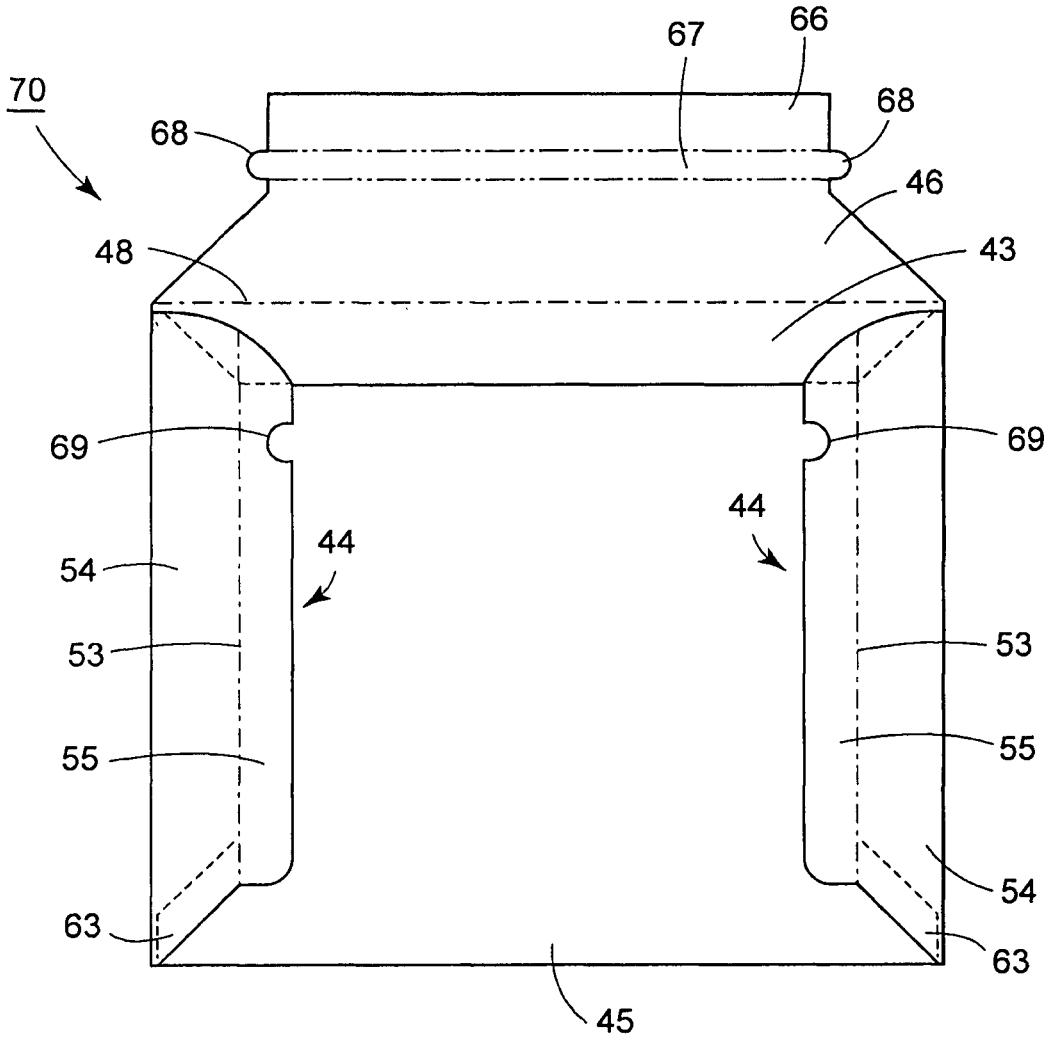
FIG. 6 illustrates a view of a mailer made from the blank of FIG. 5.

Referring to FIG. 6, the blank 42 is foldable on itself to form a mailer 70. In this respect, the back panel 45 is first folded about the fold line 47 onto the front panel 43. At this time, the top edge of the back panel 45 is spaced inwardly of the top edge of the front panel 43. In particular, a trapezoidal section of the front panel 43 is exposed beyond the top edge of the back panel 45.

Next, with any releasable cover strips removed, the two side flaps 44 are folded over the back panel 45 so that the adhesive 59 secures the outer sections 55 of each side flap 44 to the rectangular section 62 of the back panel 45. At this time, the rounded tabs 58 of the side flaps 44 project above the top edge of the back panel 45. At this time, each tab 63 lies under the inner section 54 and within the contour of the inner section 54 as seen in FIG. 6.

The closure panel 46 may then be folded over the back panel 45 without being secured in place for shipment in bulk quantities.

When placed in use, the closure panel 46 is lifted away from the back panel 45 and the pocket of the mailer 70, as indicated in FIG. 6, so that materials may be placed in the pocket. Upon filling the pocket to capacity, the mailer expands. In this respect, the first (inner) section 54 of each side flap 44 pivots about and away from the front panel 43; the second (outer) section 55 of each side flap 44 pivots relative to the first section 54 of the side flap 44 while remaining flat and parallel to the front panel 43; the trapezoidal section 61 of the back panel 45 pivots about and away from the front panel 43 and the rectangular section 62 of the back panel 45 remains flat and parallel to the front panel 43.

In addition, the tabs 63 of the back panel 45 flex relative to the trapezoidal section 61 of the back panel 45 to maintain the lower corners of the filled mailer 70 in a closed condition.

Thereafter, with a suitable adhesive on the closure panel 46, the closure panel 46 is folded over the back panel 45 allowing the adhesive to secure the closure panel 46 to the back panel 45 in a secure manner. At this time, the trapezoidal section 65 of the closure panel 46 overlies a trapezoidal section of the front panel 43 as well as the rounded tabs 58 of the side flaps 44. In addition, depending upon the filling of the mailer 70, the second or outer section 66 of the closure panel 46 flexes more or less about the score lines 48, 64 to accommodate the thickness of the materials in the pocket of the mailer 70.

Opening of the closed mailer 70 may be accomplished by removing the tear-off strip 67 in a conventional manner.

Figure 7:
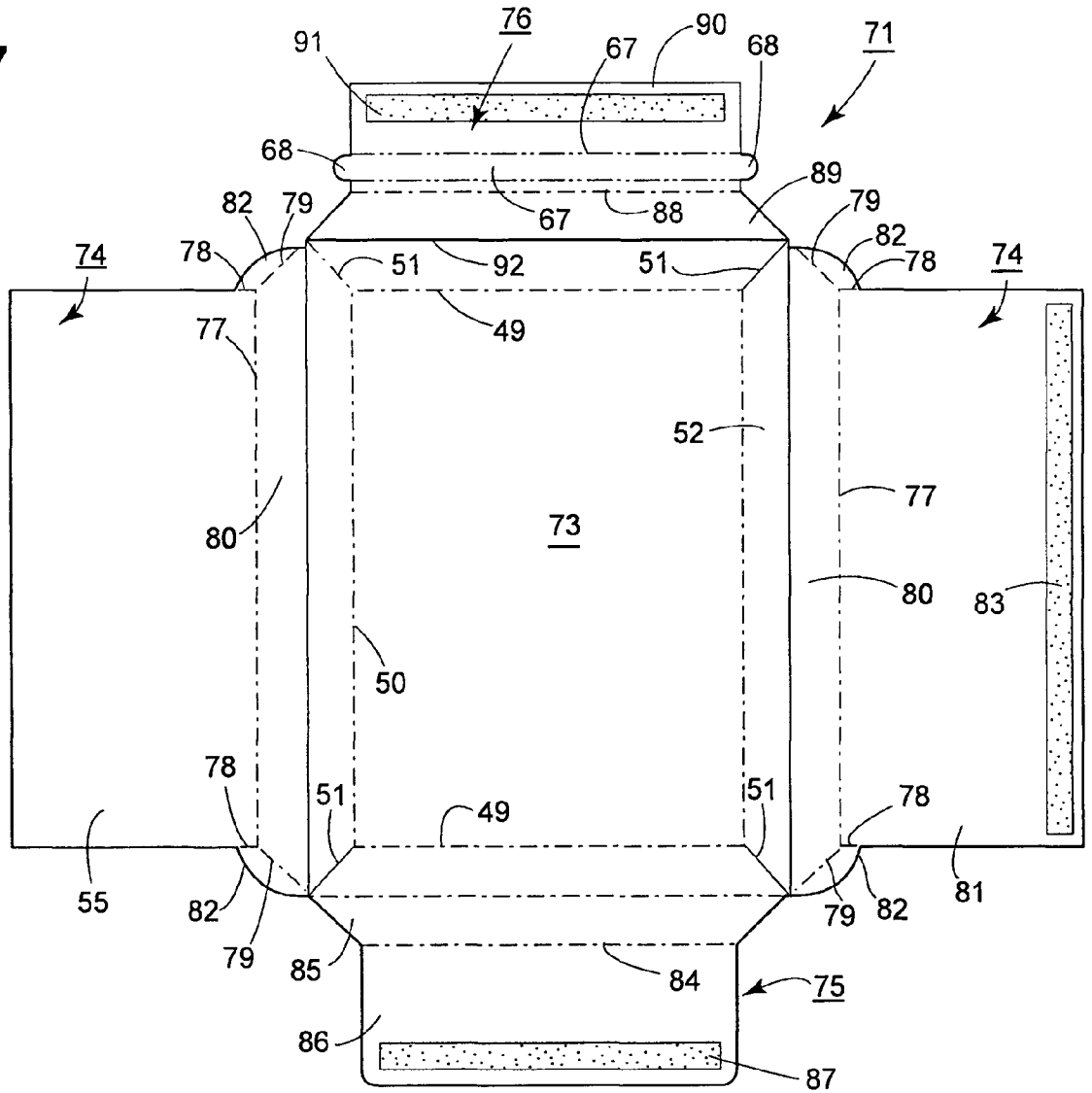
FIG. 7 illustrates a view of a blank of another embodiment used to make a center seam mailer in accordance with the invention.
Figure 8:
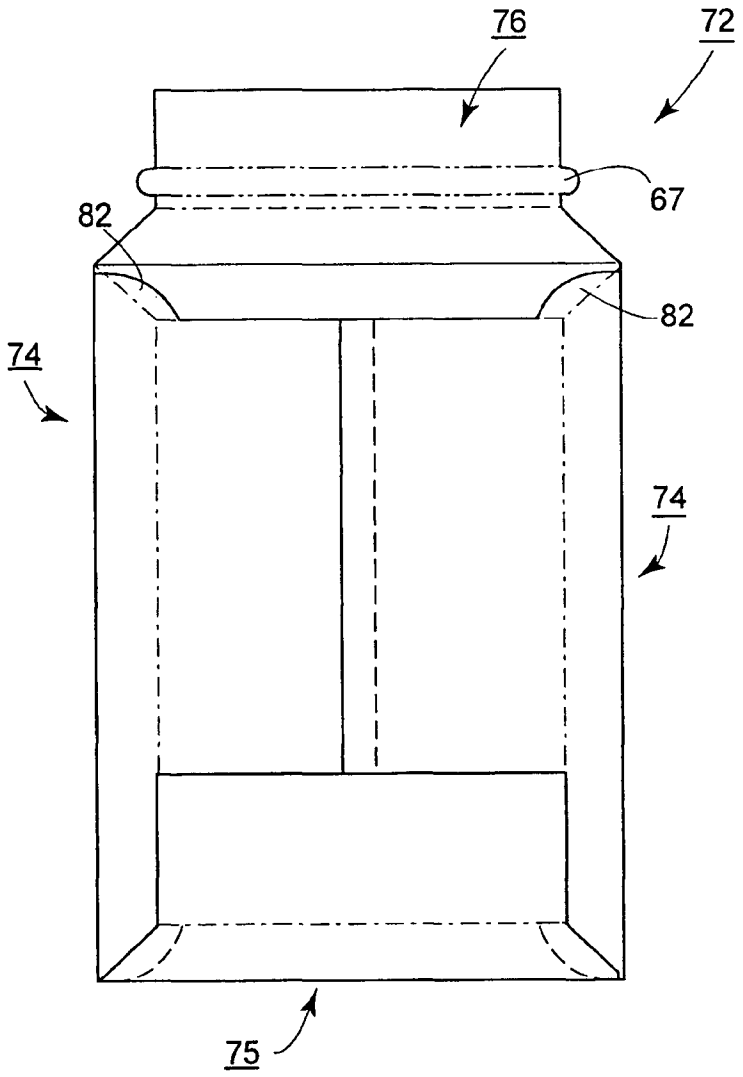
FIG. 8 illustrates a view of a mailer made from the blank of FIG. 7.

Referring to FIG. 7, wherein like reference characters indicate like parts as above, a blank 71 for forming a center seam mailer 72 as indicated in FIG. 8 includes a front panel 73 of rectangular shape; a pair of side flaps 74 extending from opposite sides of the front panel 73 for folding over the front panel 73, a bottom panel 75 extending from a bottom edge of the front panel 73 for folding over the front panel 73 and a closure panel 76 extending from the front panel 73.

The front panel 73, as in the above embodiments, may include a pair of horizontal score lines 49 spaced from the bottom panel 75 and closure panel 76, a pair of vertical score lines 50 extending from the horizontal score lines 49 and angular score lines 51 extending from the intersections of the horizontal and vertical score lines 49, 50 to the corners of the front panel. As viewed, the score lines 49, 50, 51 define a peripheral frame of four trapezoidal sections about the front panel 73

Each side flap 74 has a vertical score line 77 parallel to an edge of the front panel 73, a pair of horizontal score lines 78 and a pair of angular score lines 79. Each horizontal score line 78 extends from an end of the vertical score line 77 and each angular score line 79 extends from an intersection of the vertical score line 77 and a respective horizontal score line 78 to divide the side flap 74 into a trapezoidal section 80 extending from the front panel 73, a rectangular section 81 extending from the trapezoidal section 80 and a tab 82 extending from the trapezoidal section 80 and the rectangular section 81. As illustrated, each tab 82 has a rounded outer edge.

As illustrated, each side flap 74 has a width greater than one-half the width of the front panel 73 for folding over the front panel 73 in overlapping manner. In addition, at least one the side flaps 75 has an adhesive 83 thereon for securing the side flaps 74 together in overlying relation.

The bottom panel 75 has a horizontally disposed score line 84 spaced from a bottom edge of the front panel 73 to divide the bottom panel 75 into a trapezoidal section 85 extending from the front panel 73 and a rectangular section 86. In addition, the bottom panel 75 has an adhesive 87 on the rectangular section 86 for adhering to the side flaps. In the illustrated embodiment, the side flaps 74 are to be folded over the front panel 73 with the bottom panel 75 folded over the side flaps 74. In this case, the adhesive 87 is on the top side of the bottom panel 75, as viewed. However, where the bottom panel 75 is first folded over the front panel 73 followed by folding of the side flaps 74 over the front panel 73 and bottom panel 75, the adhesive 87 would be on the underside of the bottom panel 75.

The bottom panel 75 is of a width equal to the horizontal distance between the vertical score lines 50 on the front panel 73.

The closure panel 76 has a horizontally disposed score line 88 dividing the closure panel 76 into a trapezoidal section 89 extending from the front panel 73 and a second section 90. In addition, an adhesive 91 is disposed on the second section 90 for adhering to the side flaps 74 when the side flaps are folded over each other. For example, a remoistenable adhesive may be used for high speed heavy insertion applications and manual insertion and a peel and seal adhesive tape arrangement may be used for manual insertion.

The closure panel 76, as the bottom panel 75, is of a width equal to the horizontal distance between the vertical score lines 50 on the front panel 73 and is provided with a tear strip 67 with projections, as above.

A fold line 92 is also disposed between the front panel 73 and the closure panel 76.

In order to form the center seam mailer 72, the side flaps 74 of the blank 71 are first folded over the front panel 73 and adhesively secured together via the adhesive 83 to form a center seam. Next, the bottom panel 75 is folded over the front panel 73 and side flaps 74 and secured to the side flaps 74 via the adhesive 87 to form a pocket. At this time, the tabs 82 at the bottom edges of the side flaps 74 underlie the ends of the trapezoidal section 85 of the bottom panel 75 to securely close the bottom two corners of the pocket. In addition, the closure panel 76 remains in an unfolded state so that access may be had to the pocket for filling with materials, such as, sheets of paper.

Upon filling the pocket of the mailer 72, the mailer 72 expands to accommodate the materials inserted therein. In this regard, the front panel 73 and side flaps 74 remain parallel and flat while moving away from each other as the trapezoidal sections 80 of the side flaps 74 and the corresponding trapezoidal sections of the front panel 73 angulate relative to each other.

After filling of the pocket of the mailer 72, the closure panel 76 is folded over the side flaps 74 and secured thereto via the adhesive 90. At this time, the tabs 82 at the top edges of the side flaps 74 underlie the ends of the trapezoidal section 89 of the closure panel 76 to securely close the top two corners of the mailer 72.

Opening of the mailer can be carried out by removing the tear strip 67.

Of note, the blank 71 may be oriented on automated folding and filling equipment so that the pocket is formed with the closure panel 76 oriented as indicated in FIG. 7 for top end filling or with the closure panel oriented 90° from the position indicated in FIG. 7 for side filling. Similarly, the blanks 10, 42 of the other embodiments may be oriented in the same manner.

The center seam construction of FIG. 7 may be modified to use a different type of closure panel for mailing purposes or for filing purposes. For example, use may be made of a tuck/tab closure. In this embodiment, each side flap 74 would be provided with an angularly disposed slot (not shown) and the closure panel 76 would have a second section 90 shaped to provide a pair of outstanding ear-like tabs (not shown) for sliding into the slots of the folded over side flaps 74 when the closure panel 76 is folded to close the pocket of the construction. This embodiment is particularly useful for paperboard and heavier substrates including corrugate as well as plastic and is particularly useful for mailing with the addition of an adhesive 91 and a tear strip 67, as above.

Of note, closure of the above described embodiments of the invention may be accomplished using a button and string design or clasp enclosure rather than the tear strip type of closure described.

The invention thus provides an improved mailer construction as well as blank that can be folded into a mailer in an economical manner.

Further, the invention provides a blank that can be made of any suitable material for making a mailer, such as, paper, paperboard, chipboard and corrugated board and plastic.

What is claimed is:

1. A blank for a mailer comprising a front panel of rectangular shape;

a pair of side flaps extending from said front panel, each said side flap extending from a side edge of said front panel and having a vertical score line dividing said side flap into a first section extending from said front panel and a second section, said first section of each said side flap having an angular score line at one end extending from said front panel and said second section of each said side flap having a horizontal score line extending from said angular score line; said angular score line and said horizontal score line of said respective side flap delimiting a tab;

a back panel extending from a bottom edge of said front panel for folding over said front panel to define a pocket, said back panel having a horizontally disposed score line spaced from a bottom edge of said front panel dividing said back panel into a first trapezoidal section extending from said front panel and a rectangular section;

a closure panel extending from said front panel, said closure panel having a horizontally disposed score line dividing said closure panel into a trapezoidal section extending from said front panel and a second section; and a fold line disposed between said front panel and said closure panel.

2. A blank as set forth in claim 1 wherein each said tab on a respective side flap has a rounded outer edge.

3. A blank as set forth in claim 2 wherein each said tab on a respective side flap is at a top edge of a respective side flap.

4. A blank as set forth in claim 3 wherein said first section of each said side flap has a second angular score line at a bottom end extending from said front panel and said second section of each said side flap has a second horizontal score line extending from said second angular score line to delimit a tab extending from said first section of each said side flap.

5. A blank as set forth in claim 1 further comprising a pair of tabs extending from said back panel, each said tab extending from a respective end of said trapezoidal section and said rectangular section of said front panel and being of rhombic shape.

6. A blank for a mailer as set forth in claim 1 wherein said closure panel includes a horizontally disposed integral tear-off strip in said second section.

7. A blank for a mailer as set forth in claim 6 wherein each said flap has a recess and said tear-off strip has a tab extending from each end thereof.

8. A blank as set forth in claim 1 wherein said front panel includes a pair of horizontal score lines spaced from the bottom panel and closure panel, a pair of vertical score lines extending from said horizontal score lines and angular score lines extending from the intersections of said horizontal and vertical score lines to the corners of said front panel.

9. A blank as set forth in claim 8 wherein said back panel is of a width equal to the horizontal distance between said vertical score lines on said front panel.

10. A blank as set forth in claim 1 wherein each said side flap has a width greater than one-half the width of said front panel.

11. A mailer comprising a front panel of rectangular shape;

a back panel extending from a bottom edge of said front panel and folded over said front panel to define a pocket, said back panel having a horizontally disposed score line spaced from a bottom edge of said front panel dividing said back panel into a trapezoidal section extending from said front panel and a rectangular section;

a pair of tabs extending from said back panel, each said tab extending from a respective end of said trapezoidal section and said rectangular section of said back panel and being of rhombic shape; and a pair of side flaps extending from said front panel and folded over said back panel, each said side flap extending from a side edge of said front panel and having a vertical score line dividing said side flap into a first section extending from said front panel and a second section, said first section being disposed over a respective tab of said pair of tabs.

12. A mailer as set forth in claim 11 wherein said first section of each said side flap has an angular score line at an upper end extending from said front panel and said second section of each said side flap having a horizontal score line extending from said angular score line to an edge of said respective flap; said angular score line and said horizontal score line of said respective side flap delimiting a tab.

13. A mailer as set forth in claim 11 wherein each said tab on a respective side flap has a rounded outer edge.

14. A mailer as set forth in claim 11 further comprising a closure panel extending from said back panel, said closure panel having a horizontally disposed score line dividing said closure panel into a trapezoidal section extending from said back panel and a second section disposed over each said tab of each said side flap.

15. A mailer as set forth in claim 14 wherein each of said side flaps has an adhesive thereon securing said side flaps in overlying relation to said back panel.

16. A mailer as set forth in claim 14 wherein said front panel includes a pair of horizontal score lines spaced from the bottom panel and said closure panel, a pair of vertical score lines extending from said horizontal score lines and angular score lines extending from the intersections of said horizontal and vertical score lines to the corners of said front panel.

17. A mailer as set forth in claim 16 wherein said back panel is of a width equal to the horizontal distance between said vertical score lines on said front panel.

18. A mailer as set forth in claim 14 wherein said closure panel includes a horizontally disposed integral tear-off strip in said second section having a tab extending from each end thereof and wherein each said flap has a recess receiving a respective tab.

19. A mailer comprising a front panel of rectangular shape;

a back panel extending from a bottom edge of said front panel and folded over said front panel to define a pocket, said back panel having a horizontally disposed score line spaced from a bottom edge of said front panel dividing said back panel into a trapezoidal section extending from said front panel and a rectangular section;

a pair of side flaps extending from said front panel and folded over said back panel, each said side flap extending from a side edge of said front panel and having a vertical score line dividing said side flap into a first section extending from said front panel and a second section, said first section of each said side flap having an angular score line at one end extending from said front panel and said second section of each said side flap having a horizontal score line extending from said angular score line; said angular score line and said horizontal score line of said respective side flap delimiting a tab; and a closure panel extending from said back panel, said closure panel having a horizontally disposed score line dividing said closure panel into a trapezoidal section extending from said back panel over said front panel and a second section disposed over each said tab of each said side flap.

20. A mailer as set forth in claim 19 wherein each said side flap has a width greater than one-half the width of said front panel.

21. A mailer as set forth in claim 19 wherein said first section of each said side flap has a second angular score line at a bottom end extending from said front panel and said second section of each said side flap has a second horizontal score line extending from said second angular score line to delimit a tab extending from said first section of each said side flap and along said second section.

22. A mailer as set forth in claim 19 further comprising a pair of tabs extending from said back panel, each said tab extending from a respective end of said trapezoidal section and said rectangular section of said back panel and being of rhombic shape.

23. A blank as set forth in claim 1 wherein said back panel is coextensive with said front panel and said closure panel is coextensive with said front panel.

* * * * *